US007926665B2

(12) United States Patent
Schneider

(10) Patent No.: US 7,926,665 B2
(45) Date of Patent: Apr. 19, 2011

(54) METHOD AND APPARATUS FOR TRANSFERRING SHEET PRODUCTS FROM A PRODUCT STACK TO A CONVEYOR BELT

(75) Inventor: Marcel Schneider, Cham (CH)

(73) Assignee: Ferag AG, Hinwil (CH)

( * ) Notice: Subject to any disclaimer, the term of this patent is extended or adjusted under 35 U.S.C. 154(b) by 319 days.

(21) Appl. No.: 12/092,332

(22) PCT Filed: Oct. 2, 2006

(86) PCT No.: PCT/CH2006/000534
§ 371 (c)(1),
(2), (4) Date: Aug. 19, 2008

(87) PCT Pub. No.: WO2007/051324
PCT Pub. Date: May 10, 2007

(65) Prior Publication Data

US 2010/0171258 A1 Jul. 8, 2010

(30) Foreign Application Priority Data

Nov. 1, 2005 (CH) ..... 1750/05

(51) Int. Cl.
*B07C 5/36* (2006.01)

(52) U.S. Cl. ..... 209/617; 198/470.1; 271/11

(58) Field of Classification Search ..... 209/617; 271/10.01, 11, 101, 69, 82, 95; 198/470.1
See application file for complete search history.

(56) References Cited

U.S. PATENT DOCUMENTS

| | | | | |
|---|---|---|---|---|
| 5,398,920 | A * | 3/1995 | Leu | 271/3.07 |
| 6,182,960 | B1 * | 2/2001 | Keller et al. | 271/82 |
| 6,196,538 | B1 * | 3/2001 | Stauber et al. | 271/69 |
| 6,554,268 | B1 * | 4/2003 | Keller et al. | 271/11 |
| 6,666,447 | B2 | 12/2003 | Keller | |
| 6,702,276 | B2 | 3/2004 | Müller | |
| 2009/0289409 | A1 * | 11/2009 | Fenile | 271/10.09 |

FOREIGN PATENT DOCUMENTS

EP 1055620 A1 * 11/2000

OTHER PUBLICATIONS

International Search Report for International Application No. PCT/CH2006/000534.

* cited by examiner

*Primary Examiner* — Terrell H Matthews
(74) *Attorney, Agent, or Firm* — Alston & Bird LLP

(57) ABSTRACT

The method according to the invention of transferring stacked, sheet-like, flexible products (10), in particular printed products (12), to a belt conveyor (20) has a gripper (26) by means of which the product (10) at the bottom of the stack of products in each case is conveyed from a receiving region into a transfer region (19). In the transfer region, the product (10) is deposited on the belt conveyor (20). In order to accelerate the product as quickly as possible to the speed, and in the conveying direction (F), of the belt conveyor (20), the method has a contact-pressure roller (54) which follows the gripper (26) in the transfer region (19). This contact-pressure roller (54) presses the product (10) onto the belt conveyor (20), the gripper (26) releasing the product (10) at least more or less at the same time as the operation of pressing the product onto the conveying belt (64) of the belt conveyor (20) commences.

14 Claims, 4 Drawing Sheets

METHOD AND APPARATUS FOR TRANSFERRING SHEET PRODUCTS FROM A PRODUCT STACK TO A CONVEYOR BELT

BACKGROUND OF THE INVENTION

1) Field of the Invention

The present invention relates to a method and an apparatus for transferring flexible sheet products stored in a product stack, in particular printed products, according to the preamble of claim 1 and of claim 7.

2) Description of Related Art

EP-A-1 226 083 discloses a method and an apparatus of this type. The apparatus is intended to break down a product stack, in particular a stack of printed products, from below and to deposit the individual products on a belt conveyor for further processing. For this purpose, the apparatus has a plurality of grippers and suction elements, each gripper being assigned a suction element preceding the gripper. The grippers and suction elements are fixed to a carrier wheel. In order to break down the stack, in a pick-up region a suction element grips the product located at the bottom in the product stack in the leading edge region of said product and transfers this product to the following gripper. This gripper holds the product firmly in the leading edge region and, as a result of rotation of the carrier wheel, the product is pulled out of the product stack. As a result of further rotation of the carrier wheel, the product is conveyed into a transfer region, in which it is deposited on a belt conveyor and, after the product has been deposited, it is released by the gripper. In the transfer region, the direction of movement of the gripper is the same as the conveying direction of the belt conveyor.

This known apparatus is afflicted with the disadvantage that the conveying direction of the belt conveyor is coupled with the direction of movement of the grippers in the transfer region. This can be disadvantageous when processing folded printed products. Folded printed products are preferably gripped by the suction element or by the gripper close to the fold or gutter margin, which is consequently located in the leading edge region. As soon as the product has been deposited on the belt conveyor, the fold is once more in front. Processing of the product in such a way that, on the belt conveyor, an open edge opposite the fold forms the leading edge of the printed product and the fold forms the trailing edge of the printed product is not possible with the apparatus disclosed by EP-A-1 226 083.

Furthermore, EP-A-1 226 083 discloses supporting the product stack on a plurality of freely rotatable rolls, the rolls in the pick-up region moving from the leading edge region to the trailing edge region. As a result of gripping the leading edge region of the lowest product and pulling this edge region down through between two adjacent rolls by means of the suction element, the lowest product can be separated gently from the product stack.

The rolls are arranged on two conveyor elements and are located directly underneath the product stack in a horizontal plane. The rolls are arranged pivotably on the conveying elements such that, in a region directly underneath the product stack, the rolls are aligned in parallel at regular intervals and, outside this region, in a plane in which the conveying element is located, and are pivoted away upright.

A further, similar apparatus for the breakdown of a product stack is disclosed by EP-A 1 254 855. A product stack is once more located on freely rotatable rolls. The rolls are arranged pivotably on the conveying wheel such that, in a region under the product stack, they are aligned parallel to the axis of rotation of the conveying wheel and, outside this region, in a plane in which the conveying wheel is located, are pivoted and aligned at least approximately tangentially.

BRIEF SUMMARY OF THE INVENTION

It is an object of the present invention to develop the known method and the known apparatus in such a way that the conveying direction of the belt conveyor is decoupled from the direction of movement of the grippers in the transfer region.

According to the invention, these objects are achieved by a method having the features of claim 1 and an apparatus having the features of claim 7. According to the invention, the grippers conveying the product in the transfer region are followed by a pressure roller, by which means the product held in the gripper is forced radially outwards at a distance from the leading edge region. As soon as the product is lying on the belt conveyor and the pressure roller is pressing the product onto the conveyor, the product is carried along by a conveyor belt of the belt conveyor, the gripper releasing the product at least approximately at the same time as the start of pressing on said product.

The product is particularly preferably a folded printed product, the leading edge region running parallel to a fold of the product and adjoining the latter directly.

Particularly preferably, the product laid on the belt conveyor is conveyed in the opposite direction to the direction of movement of the grippers in the transfer region. As a result, the direction of movement of the product following deposition from the gripper to the belt conveyor is reversed.

In the apparatus according to the invention, a pressure roller follows the gripper in the transfer region and, at least approximately at the same time as the product is released from the gripper, begins to press this product onto the belt conveyor, by which means the product is immediately carried along by a conveyor belt of the belt conveyor.

In a particularly preferred embodiment of the apparatus, the conveying direction of the belt conveyor is opposite to the direction of movement of the grippers in the transfer region. As a result, that edge region which leads between the pick-up region and the transfer region trails on the belt conveyor following the transfer from the gripper to the belt conveyor.

Further preferred embodiments of the method and the apparatus are specified in the further dependant claims.

BRIEF DESCRIPTION OF THE SEVERAL VIEWS OF THE DRAWINGS

Further particular advantages and modes of action result from the detailed description and the drawing. In the following text, the invention will be explained in more detail by using exemplary embodiments illustrated in the drawing, in which, purely schematically.

DETAILED DESCRIPTION OF THE INVENTION

Figure 1:
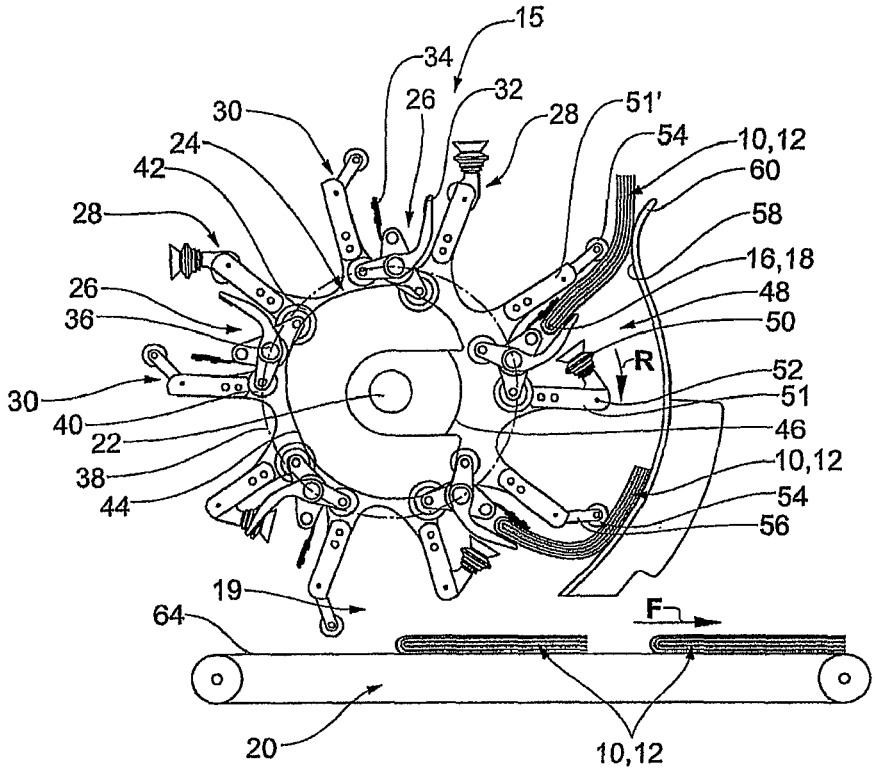
FIG. 1 shows in side view a first embodiment of a belt conveyor and a first embodiment of a carrier wheel of an apparatus according to the invention, five functional units, comprising a gripper, a suction element preceding the gripper and a pressure element following the gripper, being arranged on the carrier wheel and the direction of movement of the belt conveyor being opposite to the direction of movement of the grippers in a transfer region, in which printed products conveyed by the grippers are transferred to the belt conveyor.

FIG. 1 shows a first embodiment of a carrier wheel with grippers 26, suction elements 28 and pressure elements 30 arranged thereon and a first embodiment of a belt conveyor 20 of an apparatus according to the invention which is intended to grip flexible, sheet products 10, in particular folded printed products 12 which are present in a product stack 14 (see also FIGS. 2, 7 and 8), within a pick-up region 15 at an edge region 16 that leads in the following method step, and to deposit these products 10 on the belt conveyor 20 within a transfer region 19. If, as shown in FIG. 1, the products 10 are folded printed products 12, a fold 18 of these products 10 is located in the leading edge region 16.

Arranged radially on the outside on the carrier wheel 24, which can rotate about its wheel axle 22 and is driven by means of a drive, are the grippers 26, suction elements 28 and pressure elements 30, there being the same number of grippers 26, suction elements 28 and pressure elements 30.

The grippers 26 are arranged in the circumferential direction at regular intervals on the carrier wheel 24. Each gripper 26 is formed from two limbs 32, 34—a leading and a trailing limb—which are arranged on the carrier wheel 24 such that they can be pivoted about a gripper axis 36 and are spring-loaded in a closing direction. The gripper axes 36 are located on a circularly cylindrical outer surface 38, the axis of this circular cylinder coinciding with the wheel axle 22. The carrier wheel 24 rotates in the clockwise direction, as indicated by the arrow R. The leading limb 32 is in each case rigid and the following limb 34 is flexible. As a result, it is possible to pick up products 10 of various thicknesses without having to readjust the apparatus. Radially on the inside, each limb 32, 34 has an associated guide roller 40, 42, which are at least partly guided on slotted guides 44, 46. By means of the slotted guides 44, 46, each limb 32, 34 is controlled in a suitable way, opening, closing and pivoting of the gripper 24 about the gripper axis 34 being carried out as a function of the rotational angle of the carrier wheel 24.

On the carrier wheel 24, the suction element 28 is arranged to lead each gripper 26 at a specific distance, and the pressure element 30 is arranged to trail each gripper 26, likewise at a specific distance. The gripper 26, together with the preceding suction element 28 and the following pressure element 30, forms a functional unit 48. Consequently, the number of functional units arranged on the carrier wheel 24 is equal to the number of grippers 26.

Each suction element 28 has a suction head 50, which is attached to a base or carrier unit 51 such that it can be pivoted about a pivot axis 52 parallel to the wheel axle 22, the base or carrier unit 51 in turn being firmly arranged on the carrier wheel 24. The suction head 50 can be pivoted in a known way (in this regard, see also FIG. 4) via a pivoting drive, not shown, which has a guide roller and a slotted guide interacting with the guide roller. The base or carrier unit 51 is formed like a rod and projects in the radial direction from the carrier wheel 24.

The structure, the functioning and the interaction of the carrier wheel 24 with the grippers 26 and suction elements 28 arranged thereon are also disclosed in EP-A-1 226 083.

Each pressure element 30 has a freely rotatable pressure roller 54, which is arranged in an end region of a rod-like swinging arm 56. An end region of the swinging arm 56 that is opposite the pressure roller 54 is pivotably mounted on a base or carrier unit 51' which is firmly arranged on the carrier wheel 24, is likewise rod-like and projects in the radial direction from the carrier wheel 24. The position and movement of the swinging arm 56 are likewise controlled in a known manner (see FIG. 4 once more) via a swivel drive, which has a guide wheel and a slotted guide assigned to this guide wheel.

The products 10 held by the grippers 26 are guided between the pick-up region 15 and the transfer region 19 along a sliding surface 58. The sliding surface 58 is formed by a surface of a guide element 60, for example a guide plate, that faces the carrier wheel 24.

In the transfer region 19, the apparatus shown in FIG. 1 has an end region of the belt conveyor 20 that is placed upstream, according to a first embodiment. A conveying direction F of a conveyor belt 64 of the belt conveyor 20 is opposite to the direction of movement of the grippers 26 in the transfer region 19.

FIGS. 2 to 6 show a second embodiment of the carrier wheel 24 with grippers 26, suction elements 28 and pressure elements 30 of the apparatus according to the invention arranged thereon.

The second embodiment of the carrier wheel 24 is largely constructed in the same way as that of the first embodiment. Only the arrangement of the suction elements 28 and of the pressure elements 30 is different. The base or carrier unit 51 of each suction element 28 is likewise the base or carrier unit of the pressure element 30 of the directly preceding functional unit 48. Consequently, between two grippers 26 there is a single, joint base or carrier unit 51 for the suction head 50 and also for the swinging arm 56 with the pressure roller 54.

The swinging arm 56 that can be actuated by means of a swivel drive is constructed as one of two arms of an angled lever 70. The suction head 50 is arranged in the free end region of the other arm.

The angled lever 70 is in turn arranged in the free end region of the rod-like base or carrier element 51 such that it can be pivoted about a pivot axis 52 running parallel to the wheel axle 22. Firmly connected to the angled lever 70 is a small step-up transmission roller 72 of the swivel drive, which can be rotated about the pivot axis 52 (in this regard, see in particular FIG. 4), which interacts with a large step-up transmission roller 74 of the swivel drive arranged on the carrier roll 24, via a suitable transmission element 76, for example a toothed belt. The large step-up transmission roller 74 is firmly connected to a control lever 73 of the swivel drive, in the free end region of which a freely rotatable guide roller 78 is arranged. This guide roller 78 of the swivel drive interacts with a slotted guide, not shown, belonging to the swivel drive, by which means the position of the angled lever 70 is controlled. The arrangement of suction element and pressure roller 54 on the angled lever 70 is such that the suction element 50 faces the trailing gripper 26 and the pressure roller 54 faces the preceding gripper 26. As in the first embodiment of the carrier wheel 24, in this embodiment, too, a gripper 26 with the suction element 28—leading with respect to this gripper—and the trailing pressure element 30 forms a functional unit 48.

Figure 3:
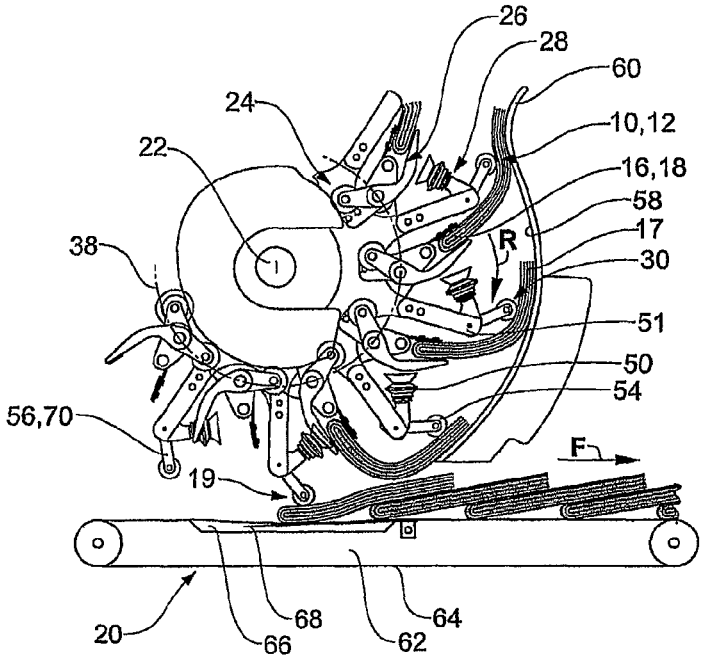
FIG. 3 shows in side view the transfer region of the apparatus according to FIG. 2, in which the products held by the grippers are deposited on a belt conveyor in accordance with a second embodiment, the direction of movement of the belt conveyor being opposite to the direction of movement of the grippers in the transfer region.
Figure 5:
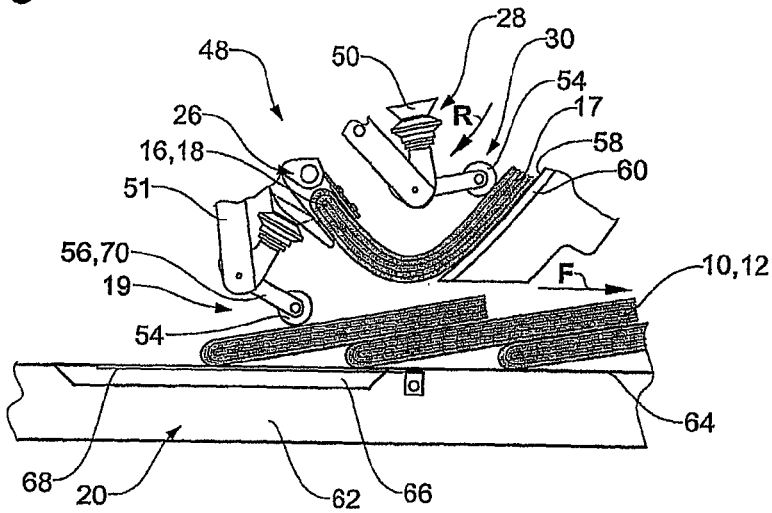
FIG. 5 shows in side view a detail of the transfer region according to FIG. 3 with a gripper, a suction element leading in comparison with the gripper and a pressure roller trailing in comparison with the gripper, which is beginning to press a printed product released by the leading gripper onto the belt conveyor.
Figure 6:
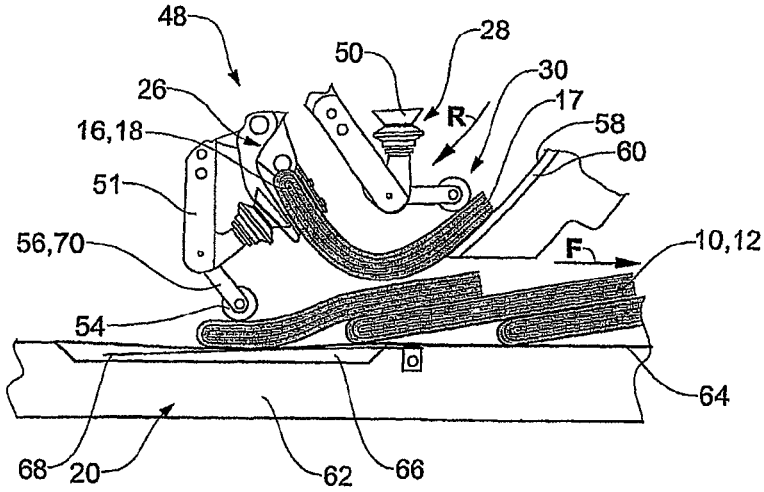
FIG. 6 shows in side view the detail according to FIG. 5 at a later time, the pressure roller pressing the released printed product onto the belt conveyor.

A second embodiment of the belt conveyor 20 is shown in FIGS. 3, 5 and 6. An active upper run of the conveyor belt 64 of the belt conveyor 20 runs in a sliding manner over a supporting element 62 of the belt conveyor 20—except in the transfer region 19. In the transfer region 19, the supporting element 62 has a depression 66, which is spanned by the upper run of the conveyor belt 64. The conveyor belt 64 in the region of the depression 66 is pressed upward from below by a leaf spring 68 fixed to an end region of the depression 66. By means of the depression 66, the belt conveyor 20 is able to compensate for differences in the thickness of the products 10. A zero position of the leaf spring 68 with respect to the upper run—and thus a pressure with which the leaf spring 68 also forces the upper run upward—is adjustable.

Of course, the belt conveyor 20 according to the first embodiment and shown in FIG. 1 can be combined with the carrier wheels 24 according to the second embodiment, shown in FIGS. 2 to 6 and, respectively, the belt conveyor 20 according to the second embodiment can be combined with the carrier wheel 24 according to the first embodiment.

Figure 7:
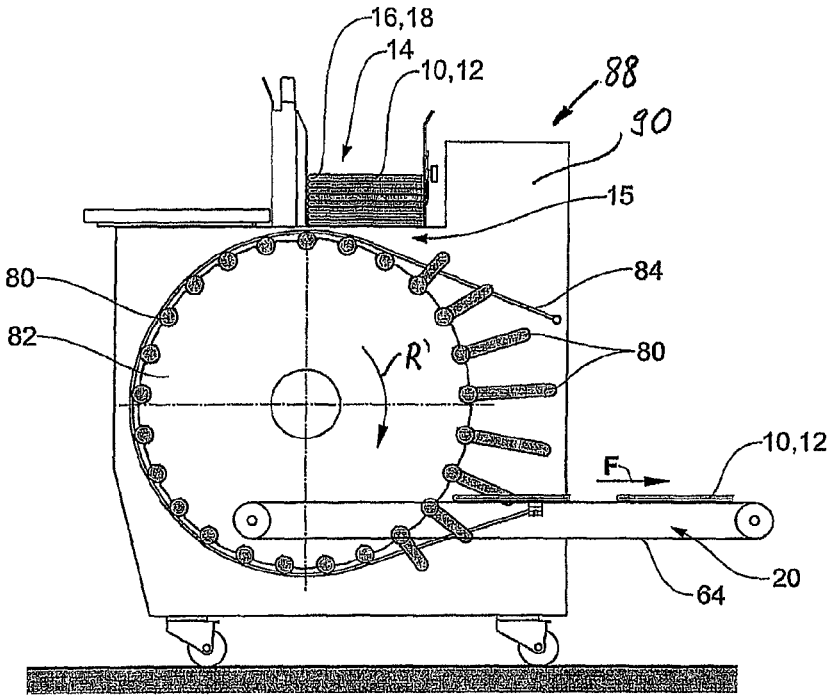
FIG. 7 shows in side view a first embodiment of the apparatus according to the invention which, in its interior, has a wheel-shaped conveying element for carrier rolls and, radially within the conveying element, a carrier wheel either according to FIG. 1 or according to FIGS. 2 to 6.
Figure 8:
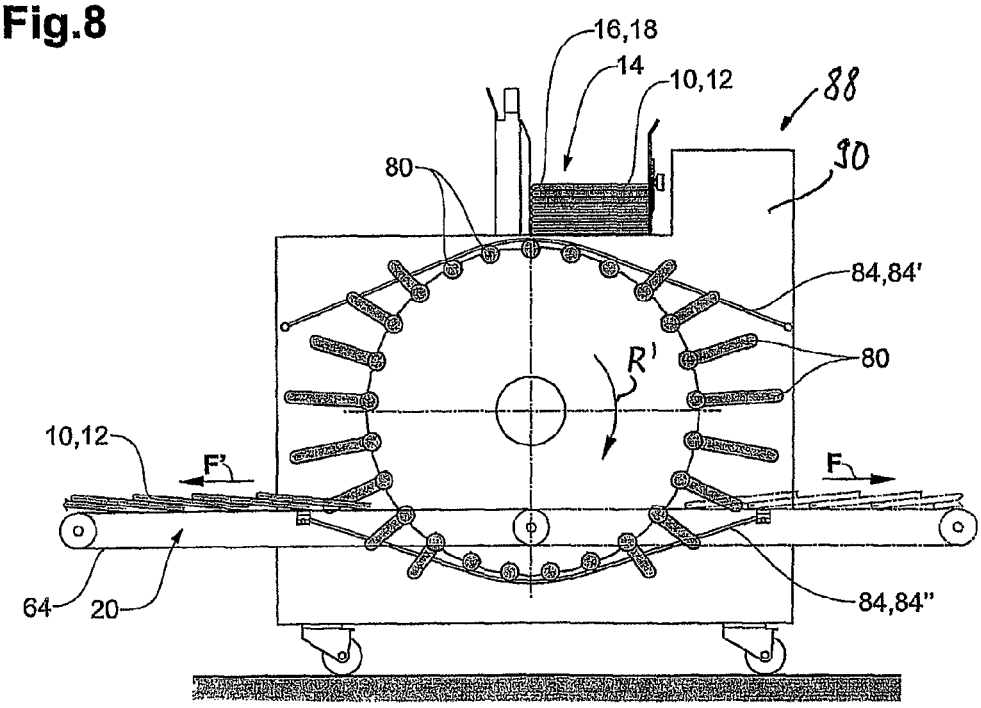
FIG. 8 shows in side view a second embodiment of the apparatus according to the invention, the conveying element for the carrier rolls permitting outward conveyance in two opposite conveying directions.

FIGS. 7 and 8 respectively show an embodiment of the apparatus according to the invention in side view; this is what is known as a feeder 88.

The apparatus shown in FIG. 7 is equipped in the interior with a carrier wheel 24 according to the first or second embodiment (see FIG. 1 or FIGS. 2 to 6), the carrier wheel 24 with the functional units 48 not being shown for the purpose of improved clarity. The belt conveyor 20 according to the first or second embodiment projects laterally out of a housing 90 of the apparatus.

The product stack 14 formed by a large number of folded products 10 (see in particular FIG. 2) rests with its leading edge region 16 on the freely rotatable carrier rolls 80, which are arranged on a conveying element 82. An edge region 17 following the leading edge region 16 rests on one or more further, likewise freely rotatable, stationary carrier rolls 80' (see FIG. 2).

The conveying element 82 for the carrier rolls 80 is formed as a wheel, which rotates about an axis parallel to the wheel axle 22 of the carrier wheel 24. The direction of rotation R' of the conveying element 82 is chosen to be the same as the direction of rotation R of the carrier wheel 24. As can be seen from FIG. 2, with respect to the wheel axle 22, the axis of the conveying element 82 is arranged underneath the latter and offset laterally. In the pick-up region 15, the carrier rolls 80 fixed to the conveying element 82 move under the product stack 14 from the leading edge region 16 in the direction of the trailing edge region 17.

Each of the carrier rolls 80 arranged on the conveying element 82 can be pivoted about an axis aligned tangentially with respect to the conveying element 82, so that it can be pivoted out of a position perpendicular to the conveying element 82, parallel to the wheel axis 22, into a position projecting radially away from the conveying element 82. Each of the carrier rolls 80 is pre-loaded by a spring element, which urges the carrier rolls 80 into the position projecting radially away from the conveying element 82. The pivoting movement of the carrier rolls 80 is controlled by means of a pivoting slotted guide 84 formed as a belt. By means of the pivoting slotted guide 84, the carrier rolls 80 are urged into the position parallel to the wheel axle 22.

The conveying element 82 is arranged laterally beside the belt conveyor 20. In order that the carrier rolls 80 are guided laterally past the belt conveyor 20, the carrier rolls 80 are pivoted between the pick-up region 15 and the transfer region 19, into the plane of the conveying element 82, by the rotational movement in the direction of rotation R' of the conveying element 82 and by the pivoting slotted guide 84.

In the embodiment shown in FIG. 7, the carrier rolls 80 are pivoted in the circumferential direction into the position parallel to the wheel axle 22 again after running past the belt conveyor 20 and remain in this position for the purpose of the subsequent support of the product stack 14. As a result of pivoting the carrier rolls 80 after running past the belt conveyor 20, the apparatus according to the invention needs little overall height.

Instead of a single conveying element 82 for the carrier rolls 80, two conveying elements can also be used, which rotate about the same axis at the same rotational speed. Each of the conveying elements is arranged at the side of the belt conveyor. Each carrier roll is in each case arranged on one of the two conveying elements in such a way that, if it is pivoted into the position parallel to the wheel axle 22, the free end region of the carrier roll points in the direction of the other conveying element and is aligned with a carrier roll arranged on the other conveying element. Furthermore, the distance between the two conveying elements is chosen in such a way that, in their position aligned parallel to the wheel axle 22, the carrier rolls are at a distance from the carrier rolls arranged on the other conveying element. The carrier wheel 24 is preferably arranged centrally between the two conveying elements. As a result, in the pick-up region 15, the suction elements 28 arranged on the carrier wheel 24 reach through a gap formed between two carrier rolls that are aligned with each other.

The embodiment of the apparatus that is shown in FIG. 8 is largely constructed in the same way as the embodiment of the apparatus shown in FIG. 7. In the apparatus according to FIG. 8, a displaceable belt conveyor according to a third embodiment is used and an arrangement of the pivoting slotted guide 84 controlling the carrier rolls 80 is changed.

The belt conveyor 20 of the embodiment shown in FIG. 8 is constructed such that it can be operated in two different positions, the products 10 deposited on the conveyor belt 64 by the grippers 26 in the one position being conveyed in the opposite direction to the direction of movement of the grippers 26 in the transfer region—in the conveying direction F as in the first embodiment shown in FIG. 7—and, in the other position, being conveyed in the direction of movement of the grippers 26, in the conveying direction F'.

In FIG. 8 the belt conveyor is illustrated in both positions, the position of the belt conveyor 20 conveying in the conveying direction F being illustrated with dash-dotted lines, and the position of the belt conveyor 20 conveying in the conveying correction F' being illustrated with continuous lines.

The belt conveyor 20 can be brought from one position to the other position in and counter to its conveying direction F, F'. In each position, the conveying direction F, F' is such that an end region of the belt conveyor 20 located upstream lies within the transfer region 19, and an end region of the belt conveyor 20 placed downstream projects out of the housing 90 of the apparatus.

Consequently, the apparatus according to the invention shown in FIG. 8 can convey folded printed products 12 in such a way that the printed products 12 are conveyed away either in the same way as the embodiment shown in FIG. 7 with the open side opposite the fold 18 in front or—as opposed to this—with the fold 18 in front.

The carrier rolls 80 of the embodiment shown in FIG. 8, as compared with the embodiment shown in FIG. 7, must consequently be pivoted in a wider range into a radially projecting position, in order that the carrier rolls 80 are guided laterally past the belt conveyor 20 in both possible positions of the latter. This is implemented by means of a divided, belt-like pivoting slotted guide 84. The one part 84' of the pivoting slotted guide 84, located at the top, forces the carrier rolls 80 in the pick-up region 15 into the position parallel to the wheel axle 22. The lower part 84" of the pivoting slotted guide 84, located at the bottom, forces the carrier rolls 80 underneath the belt conveyor 20 into a position parallel to the wheel axle 22, which means that the overall height of the apparatus can once more be kept low.

Instead of the displaceable belt conveyor shown in FIG. 8 according to the third embodiment, it is of course also possible for a belt conveyor to be used which, as compared with the belt conveyor shown in FIG. 8, has approximately twice the length, projects out of the housing 90 of the apparatus both on the one side and on the other side and can be driven in both conveying directions F, F'.

In a further possible embodiment of the belt conveyor for the apparatus shown in FIG. 8, two conveyor belts can also be arranged, each conveyor belt being formed by a plurality of conveying belts running in parallel. In the transfer region, the two conveyor belts intersect in such a way that in each case a belt of the one conveyor belt is located between two conveying belts of the other conveyor belt.

As an introduction to the functioning of the apparatus according to the invention, that which is shown by FIGS. 1 to 8 will be discussed briefly.

FIG. 1 shows the conveyance of the products 10 from the pick-up region 15 to the transfer region 19 by means of the first embodiment of the carrier wheel 24, and also the discharge of the products to the belt conveyor 20 in accordance with the first embodiment.

Figure 2:
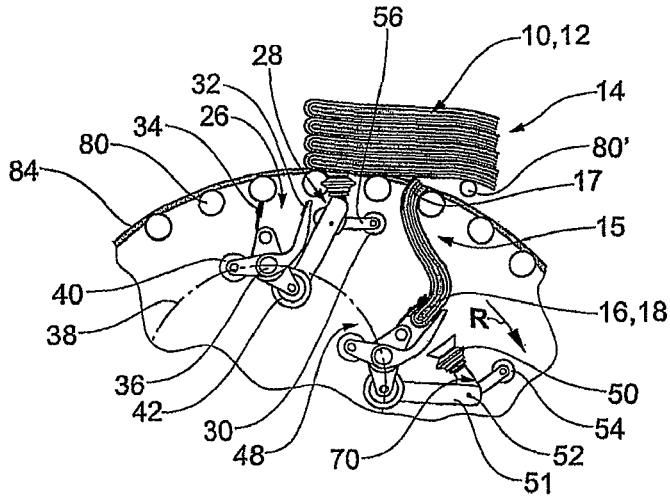
FIG. 2 shows in side view a pick-up region of the apparatus according to the invention, in which a stack of printed products resting on freely rotatable rolls is broken down from below by means of a suction element and transferred to a gripper following the suction element, the suction elements and grippers being arranged on a carrier wheel in accordance with a second embodiment.
Figure 4:
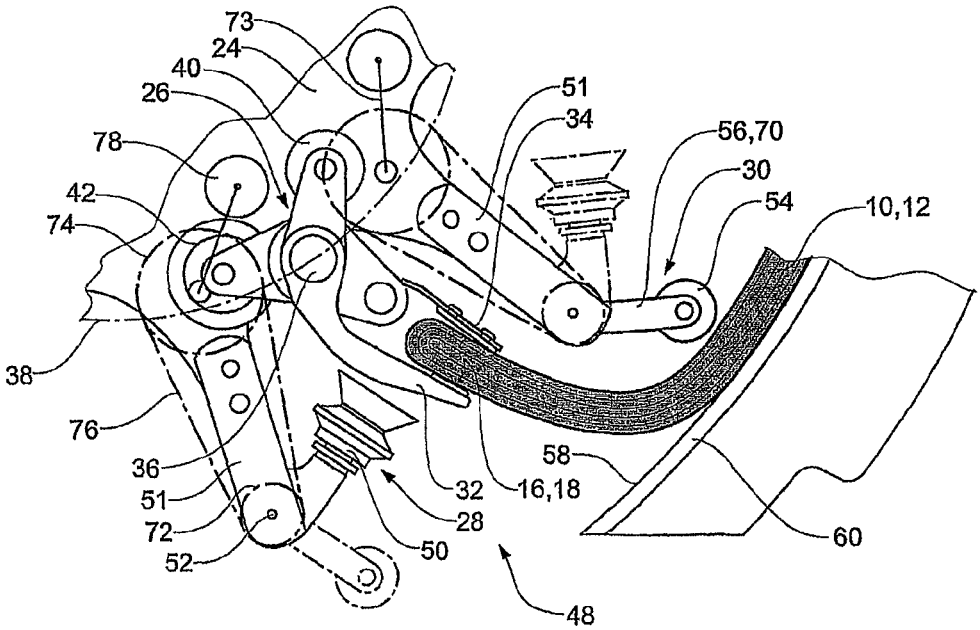
FIG. 4 shows in side view a complete functional unit arranged on the carrier wheel according to the second embodiment, comprising a gripper, a suction element preceding the gripper and a pressure element following the gripper, and also a pivoting drive, a pressure roller of the pressure element of a preceding functional unit and a suction head of a suction element of the trailing functional unit being illustrated dashed.

In FIGS. 2 to 6, picking up, conveying and discharging the products 10 by means of the second embodiment of the carrier wheel 24 are shown, the individual figures showing the following: FIG. 2 shows the actions of gripping the lowest product 10 placed in the product stack 14 and peeling off and pulling out the lowest product 10 from the product stack 14. In FIG. 3, following the pick-up region 15 shown in FIG. 2, the conveyance of the products 10 from the pick-up region 15 to the transfer region 19 and the discharge of the products to the belt conveyor 20 according to the second embodiment are shown. In FIG. 4, a region is shown which lies between the pick-up region 15 and the discharge region 19. FIGS. 5 and 6 show the discharge region 19 in each case, FIG. 6 showing this discharge region 19 at a somewhat later time than FIG. 5.

The apparatus according to the invention operates as described below, reference being made to the embodiments shown in the figures and only a single functional unit 48 being considered. All the other functional units operate in a corresponding way.

The conveying element 82 with the carrier rolls 80 fixed thereto rotates in the same direction R as the carrier wheel 24 and at the same rotational speed as the carrier wheel 24. In the present case, the carrier wheel 24 and also the conveying element 82 rotate in the clockwise direction.

As soon as it is under the product stack 14, the suction element 28 grips (see FIG. 2) the lowest product 10 in the edge region 16 which leads in the subsequent method step. If, as shown in the drawing, folded printed products 12 are being processed, the product is gripped close to the fold 18. After the gripping action, the suction element 28 is pivoted in the counterclockwise direction, in the direction of the following gripper 26 of the same functional unit 48, while the carrier wheel 24 rotates in the direction of the arrow R. In the process, the product 10 is drawn through a gap between two adjacent carrier rolls 80.

As soon as the leading edge region 16 is located in the mouth of the gripper 26, the gripper 26 is closed. As a result of further rotation of the carrier wheel 24 and as a result of the movement of the carrier rolls 80 from the leading edge region 16 to the opposite, trailing edge region 17, the lowest product 10 is peeled off the product stack 14. This type of stack breakdown—gripping the lowest product 10 by means of the suction element 28 and subsequently transferring the product 10 to the gripper 26—is already described in EP-A-1 226 083. As a result of further rotation of the carrier wheel 24, the product 10 held in the gripper 24 comes into contact with the lateral sliding surface 58 (see FIGS. 1, 3), which means that the product 10 is led away downward in a controlled manner. For this purpose, the pressure roller 54 together with the sliding surface 58 forms a guiding gap, in which the trailing edge region of the product 10 is held loosely.

As a result of the rotation of the carrier wheel 24 (see FIGS. 1, 3, 5, 6), the product 10 gets from the pick-up region 15 into the transfer region 19. In the transfer region 19, the product 10 is initially still held by the gripper 26 while the trailing edge region of the product 10 is resting on the sliding surface 58 (see FIGS. 5 and 6). A central region of the product 10, if an overlapped formation is formed on the belt conveyor, comes firstly into contact with products 10 already deposited on the conveyor belt 64 or directly into contact with the conveyor belt 64, but with the product 10 still being held by the gripper 26.

As a result of further rotation of the carrier wheel 24, the product 10—apart from the leading edge region 16 held by the gripper 26—finally comes into contact with the conveyor belt 64 or the product 10 previously deposited on the belt conveyor 20. Shortly before the pressure roller 54 presses the product 10 onto the conveyor belt 64, the leading edge region 16 is released by the gripper 26. If, as shown in FIGS. 3, 5, 6 and 8, an overlapping formation is formed by the products 10 on the conveyor belt 20, the product 10 is preferably pressed onto the conveyor belt 64 by the pressure roller 54 in a region outside the overlap of the preceding product 10. In order to press the product 10 onto the conveyor belt, the pressure roller is pivoted by means of the pressure roller 78 interacting with a slotted guide (in this regard, see also FIG. 4). The pressure roller 78 consequently ensures that the product 10 is carried along immediately by the conveyor belt 64.

In FIGS. 1, 3, 5-7, the conveying direction F of the belt conveyor 20, indicated by the arrow, in the transfer region 19 is opposite the direction of movement of the grippers 26. This means that, in the transfer region 19, the direction of movement of the individual products 10 is reversed after they have been discharged by the gripper 26. If, as shown in FIGS. 3, and 6, folded printed products 12 are being processed, which are gripped by the suction element 28 or the gripper 26 at the fold 18 and, consequently, the fold 18 is initially located in the leading edge region 16, after the product 10 has been deposited on the conveyer belt 64 the folded printed product 12 is conveyed with the fold 18 following the open side.

As shown in FIG. 8, the conveying direction F' of the belt conveyor 20 can also be oriented in the same way as the conveying direction of the grippers 26 in the transfer region 19.

Depending on the conveying speed of the belt conveyor 20 with respect to the circumferential speed of the carrier wheel 24, as shown in FIGS. 3, 5, 6 and 8, an overlapping formation is formed from the products 10 broken down from the product stack 14 or, if the conveying speed is increased (see FIGS. 1, 7), the products 10 are placed on the conveyor belt 64 individually and spaced apart from one another.

In order that products 10, 12 of large different thicknesses can be processed, the belt conveyor 20 is adjustable in terms of its vertical distance from the wheel axle 22 of the carrier wheel 24 and thus from the pressure rollers 54. If the belt conveyor 20 has the leaf springs 68, small tolerances in the thickness of the products 10 are accommodated by said leaf springs. Likewise, by means of the leaf springs 68, it is possible to ensure that sufficiently high friction prevails between the conveyor belt 64 and the product 10 which is pressed onto the conveyor belt 64 by the pressure roller 54, so that the product 10 is carried along immediately by the conveyor belt 64.

The invention claimed is:

1. A method for transferring flexible sheet products, in particular printed products, stored in a product stack, onto a belt conveyor, in which the product stack is supported from below and each individual product is gripped in its edge region that leads in the following method step by means of a suction element which is arranged underneath the product stack, the product that is gripped is accepted by a gripper that grips its leading edge region and runs on a closed circulation path and, by means of said gripper, is transported to the belt conveyor and deposited on the belt conveyor within a transfer region, the direction of movement of the gripper in its pick-up region placed underneath the product stack running substantially from the leading edge region to the trailing edge region of the products in the product stack, wherein the product is pressed onto the belt conveyor by means of a pressure roller following the gripper in the transfer region and the gripper releases the product at least approximately at the same time as the start of the pressing action.

2. The method as claimed in claim 1, wherein the products are folded printed products, the leading edge region running parallel to a fold of the product and adjoining the latter directly.

3. The method as claimed in claim 1, wherein after being released by the gripper, the product laid on the belt conveyor is conveyed away in the opposite direction (F) to the direction of movement of the grippers in the transfer region.

4. The method as claimed in claim 1, wherein after being released by the gripper, the product laid on the belt conveyor is conveyed away in the direction of movement of the grippers in the transfer region.

5. The method as claimed in claim 1, wherein the circulation path of the gripper is at least approximately a circular path.

6. The method as claimed in claim 1, wherein the products are guided between the pick-up region and the transfer region along a sliding surface, preferably for some time, with a region facing away from the gripper.

7. An apparatus comprising a carrier wheel for transferring flexible sheet products stored in a product stack onto a belt conveyor, in which the product stack is supported from below, a suction element which is arranged underneath the product stack and grips each individual product in its edge region that leads in the following method step and transfers the product to a gripper that runs on a closed circulation path within a pick-up region, the direction of movement of the gripper in its pick-up region running substantially from the leading edge region to the trailing edge region of the products in the product stack, and the gripper laying the product that is picked up on a belt conveyor within a transfer region, and wherein in the transfer region a pressure roller follows the gripper and, at least approximately at the same time as the gripper releases the product, starts to press the product onto the belt conveyor.

8. The apparatus as claimed in claim 7, wherein in the transfer region, the conveying direction (F) of the belt conveyor is opposite to the direction of movement of the grippers.

9. The apparatus as claimed in claim 7, wherein in the transfer region, the conveying direction (F) of the belt conveyor is at least approximately the same as the direction of movement of the grippers.

10. The apparatus as claimed in claim 7, wherein radially outside the circulation path of the grippers there is arranged a sliding surface, on which the products are guided between the pick-up region and the transfer region with a region facing away from the gripper.

11. The apparatus as claimed in claim 7, wherein a plurality of grippers are provided which circulate on the circulation path, the circulation path being at least approximately a circular path.

12. The apparatus as claimed in claim 11, wherein each gripper is assigned an individual pressure roller.

13. The apparatus as claimed in claim 11, wherein the grippers are arranged in the circumferential direction distributed at regular intervals on the carrier wheel, between two grippers following each other in the circumferential direction in each case there is arranged a carrier, to which a swinging arm is attached and at the free end of which one of the pressure rollers is arranged.

14. The apparatus as claimed in claim 13, wherein the swinging arm is formed by one arm of an angled lever, in the one free end region of which the pressure roller is arranged and in the other free end region of which a suction head of the suction element is arranged.

* * * * *